US005749186A

United States Patent [19]

Kaufman et al.

[11] Patent Number: 5,749,186

[45] Date of Patent: May 12, 1998

[54] MULTISTORY BUILDING COMPLEX WITH ACCESS BETWEEN GARAGE PARKING DECKS AND EACH BUILDING FLOOR AT SAME ELEVATION

[76] Inventors: Mark I. Kaufman; Donald J. Meeks, Jr., both of 15995 N. Barkers Landing, Houston, Tex. 77079

[21] Appl. No.: 607,872

[22] Filed: Feb. 27, 1996

[51] Int. Cl.[6] ..... E04H 14/00

[52] U.S. Cl. ..... 52/236.3; 52/174; 52/175

[58] Field of Search ..... 52/236.3, 174, 52/175; D25/5, 12, 3, 34

[56] References Cited

FOREIGN PATENT DOCUMENTS 6167130 6/1994 Japan ..... 52/175

OTHER PUBLICATIONS

William B. Tabler, Progressive Architecture, vol. XL, issue #6, p. 80, Jun. 1959.

*Primary Examiner*—Christopher Kent

*Attorney, Agent, or Firm*—Akin, Gump, Strauss, Hauer & Feld, L.L.P.

[57] ABSTRACT

A multistory, multiple dwelling unit building complex includes a multistory vehicle parking garage having vertically spaced parking decks which are disposed at the same elevations as the building corridors or breezeways which provide pathways to dwelling unit entrances in the buildings at various levels. Bridges or catwalks interconnect each parking deck with a corresponding corridor or breezeway at each floor of each building so that an occupant of a particular unit in a building may move between the unit entrance and a corresponding parking deck in the garage without changing elevation. The buildings may be clustered around plural sides of the garage with each building being connected to the garage by vertically spaced bridges or catwalks connecting the respective building levels with a corresponding parking deck. The garage may include elevators, stairways, trash disposal ducts and mailbox clusters at one or more corners of the garage. The elevators may be arranged to provide for movement between a furniture loading and unloading zone at ground level and the parking deck at the same elevation as the unit into which or from which the article or furniture is being moved. The building and garage arrangement provides for high density residential housing with a garage parking space for each dwelling unit and ease of movement between the garage and each dwelling unit.

12 Claims, 4 Drawing Sheets

MULTISTORY BUILDING COMPLEX WITH ACCESS BETWEEN GARAGE PARKING DECKS AND EACH BUILDING FLOOR AT SAME ELEVATION

SPECIFICATION

1. Field of the Invention

The present invention pertains to a multistory, multiunit clustered building complex with a multistory garage and catwalks or bridges between each building floor and corresponding parking decks in the garage. The garage may include one or more elevator, mailbox and trash collection facilities at each level.

2. Background

The ever-increasing cost of urban land together with the need to provide affordable high density housing, as well as low cost commercial or professional office space, presents several problems in the development of building complexes which include motor vehicle parking facilities. In particular, the need to develop affordable high density housing, such as apartment or condominium complexes, has presented a problem in providing adequate space for parking personal motor vehicles in close proximity to the apartment or condominium building or buildings without encountering the prohibitive cost of erecting buildings with garage facilities directly above or, more commonly, below the building floors or levels which are dedicated to multiple dwelling units.

National and local regulatory requirements with respect to fire ratings of structures with garages directly underneath residential dwelling units is cost prohibitive with respect to providing affordable housing in many urban areas. Moreover, the irregular shape of land parcels usually available for high density housing in highly developed urban areas also presents a problem with respect to the placement of adequate parking spaces for personal automobile vehicles which are closely adjacent the vehicle owner's dwelling unit.

One solution to the above-mentioned problem is the development of multistory garages for motor vehicles directly adjacent to the buildings which include the dwelling units to be occupied by the persons normally parking their vehicles in the garage. Multistory garages are desired in areas where land costs require a maximum utilization of land area for rentable or saleable building space. However, multistory garages can be inconvenient to use for many building occupants if parking is required on a lower or upper level of the garage and a pathway between an upper level dwelling unit and the garage requires travel between ground level and the upper garage level as well as travel between ground level and an upper level dwelling or other occupiable unit in the building or buildings adjacent to the garage. Multistory garages have been constructed wherein connecting bridges or walkways between parking decks and upper floors of buildings adjacent thereto have required stairways interconnecting the walkways or bridges with the parking decks since the decks and the respective building floors have not been placed at the same elevations. Such arrangements have been unsatisfactory for elderly and disabled persons as well as when moving large articles and furnishings between the garage and living units on the closest adjacent floors.

Other considerations which must be taken into account in the development of high density housing with multistory garages adjacent thereto concerns placement of the garage with respect to the dwelling units while maintaining adequate open space therebetween to conform to regulatory requirements and aesthetic desires of the building occupants.

It has been deemed highly desirable to be able to provide the same access between a building dwelling unit on an upper floor or level and a story garage parking space as is provided for persons occupying a ground floor dwelling unit and corresponding ground level parking. Consideration should be given not only to the convenience of walking a substantially level pathway between a dwelling unit and the parking place for the building occupants' personal vehicles, but also with regard to such activities as trash disposal, mail delivery and pickup and the ease of moving personal effects and furniture in and out of a dwelling unit. It is to all of these ends that the present invention has been developed.

SUMMARY OF THE INVENTION

The present invention provides a unique multistory building complex having multiple dwelling units on multiple building levels and a motor vehicle garage directly adjacent the building or buildings which has parking decks disposed at the same elevations as the respective building floors or levels and interconnected to each building level by a bridge or catwalk structure. The invention thus provides ease of movement between a dwelling unit on a particular building floor and a parking deck at the same or substantially the same elevation in the vehicle garage. In this way, persons occupying dwelling units on a particular floor or level of the building may also have a vehicle parking space at the same elevation within the garage and be able to move between the vehicle parking space and the dwelling unit without climbing or descending stairways or requiring transportation utilizing an elevator or the like.

In accordance with another aspect of the present invention, a multistory, multiunit building is provided in combination with a multilevel vehicle garage which is disposed directly adjacent the building but detached therefrom and spaced a sufficient distance to minimize the hazards of fire associated with motor vehicle storage while providing an aesthetically pleasing building clustering arrangement, suitable air circulation and ease of movement between building dwelling units and the garage.

In accordance with yet a further aspect of the invention, a unique multistory, multiunit building complex is provided in combination with a common garage for a plurality of multiunit buildings, which garage is interconnected with each building and has a parking deck disposed at the same elevation as each floor of the building so that persons occupying the buildings and parking their motor vehicles in the garage are not required to move up and down major stairways or use elevators, except as desired. Such an arrangement is convenient, of course, for persons carrying packages and other large articles and is of significant benefit to persons having physical disabilities which preclude or make difficult the use of stairways as well as elevators.

The present invention further provides a unique multistory garage for a clustered multistory apartment or condominium building complex wherein facilities useful to occupants of each building level, such as mailboxes, trash receptacles, elevators and stairways, are available at substantially the same elevation as the occupants' dwelling units. The garage arrangement also advantageously provides vehicle loading and unloading spaces adjacent to the garage and in proximity to an elevator.

Those skilled in the art will further appreciate the above-mentioned advantages and superior features of the invention together with other important aspects thereof upon reading the detailed description which follows in conjunction with the drawing.

DESCRIPTION OF A PREFERRED EMBODIMENT

Figure 1:
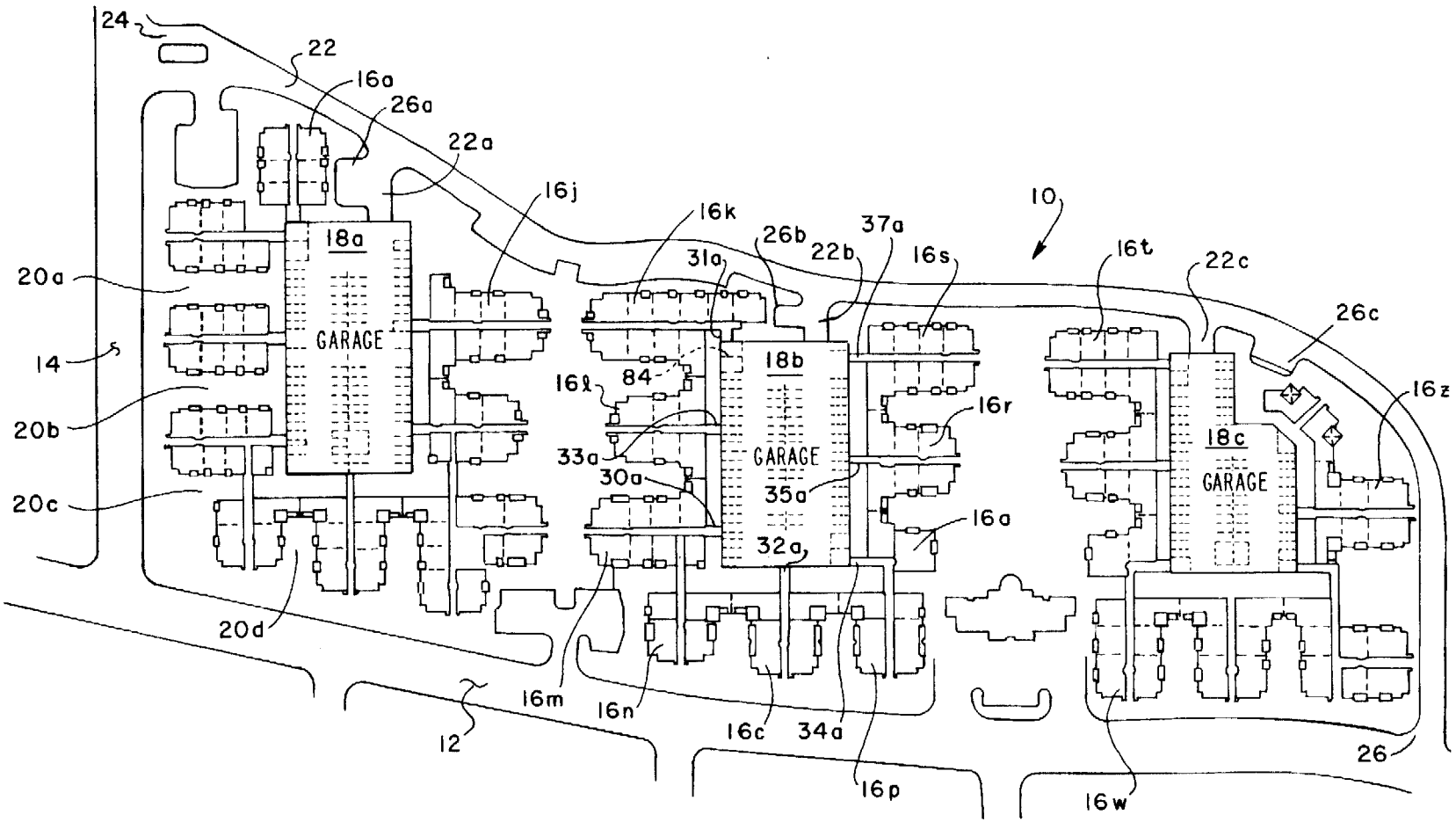
FIG. 1 is a plan view of a multistory, multiunit building complex in combination with plural multistory garages in accordance with the present invention.

In the description which follows, like elements are marked throughout the specification and drawing with the same reference numerals, respectively. The drawing figures may not necessarily be to scale in the interest of clarity and conciseness. Conventional elements may be shown in somewhat schematic or generalized form, also in the interest of clarity and conciseness.

Referring to FIG. 1 there is illustrated a plan view of a relatively large, high density, residential, multistory apartment or condominium building complex, generally designated by the numeral 10, typically of a type to be built in urban environments adjacent to public roadways 12 and 14, for example. The building complex 10 is characterized by several multistory, multi-dwelling unit buildings, actually twenty-six in total number shown in the plan view of FIG. 1 and designated by the numerals 16*a* through 16*z*. Buildings 16*a* through 16*j* are clustered around a multistory motor vehicle parking garage 18*a*, buildings 16*k* through 16*s* are clustered around a multistory vehicle parking garage 18*b* and buildings 16*t* through 16*z* are clustered around a multistory vehicle parking garage 18*c*. Buildings 16*a* through 16*z* are spaced apart from each other in such a way as to provide sufficient exterior windows and views of common courtyards between buildings, such as courtyards 20*a*, 20*b*, 20*c* and 20*d*, for example. The building complex 10 further includes a private motor vehicle roadway 22 having entrances 24 and 26 to and from the respective roadways 14 and 12. Each garage 18*a* through 18*c* has a suitable entry roadway 22*a*, 22*b* and 22*c*, respectively, from the roadway 22. Each garage 18*a* through 18*c* is also provided with a vehicle parking zone or space 26*a*, 26*b* and 26*c*, respectively, disposed adjacent to the respective garages for large article or furniture loading and unloading. The locations of the zones 26*a* through 26*c* will be further appreciated by those skilled in the art upon reading the detailed description hereinbelow.

The multiunit building complex 10 is somewhat exemplary of the present invention and advantageously provides for clustering multiple, somewhat separate buildings around the garages 18*a*, 18*b* and 18*c*. Each building 16*a* through 16*z* is preferably a multistory building comprising two or more floors or levels of occupiable units, preferably apartments or similar dwelling units. Four story buildings 16*a* through 16*z* are shown by way of example. By clustering the buildings 16*a* through 16*z* around the respective garages 18*a* through 18*c*, as illustrated, occupants of each dwelling unit in a building enjoy convenient access to the garage adjacent to the building defining the dwelling unit and each garage has a vehicle parking deck which is at substantially the same elevation as the elevation of a dwelling unit floor or level of an adjacent building. Although garages 18*a* and 18*b* actually show buildings disposed adjacent all four sides of a rectangular garage, those skilled in the art will recognize that the present invention is not limited to an arrangement wherein buildings are adjacent all sides of a garage. In fact, the arrangement of the garage with respect to one or more apartment buildings may be such that the buildings are disposed adjacent only one side of the garage, or two sides of the garage or three sides of the garage. Moreover, the garage may not necessarily be rectangular in shape such as the exemplary garages 18*a* and 18*b*. A non-rectangular garage 18*c* is shown by way of example also.

Each garage is connected to each building floor or level by suitable bridge or catwalk means to be described in further detail herein. Accordingly, a resident of a building such as any one of buildings 16*m* through 16*q*, for example, may have access to a vehicle parking space in garage 18*b* at the same elevation or level as the resident's dwelling unit. Moreover, as indicated in FIGS. 1 and 2, each of the buildings 16*a* through 16*z* is spaced from the respective garages 18*a* through 18*c* at least a sufficient distance, required by some regulations to be at least fifteen feet, to provide air circulation, minimize fire hazard and improve the aesthetics of the complex 10.

Figure 2:
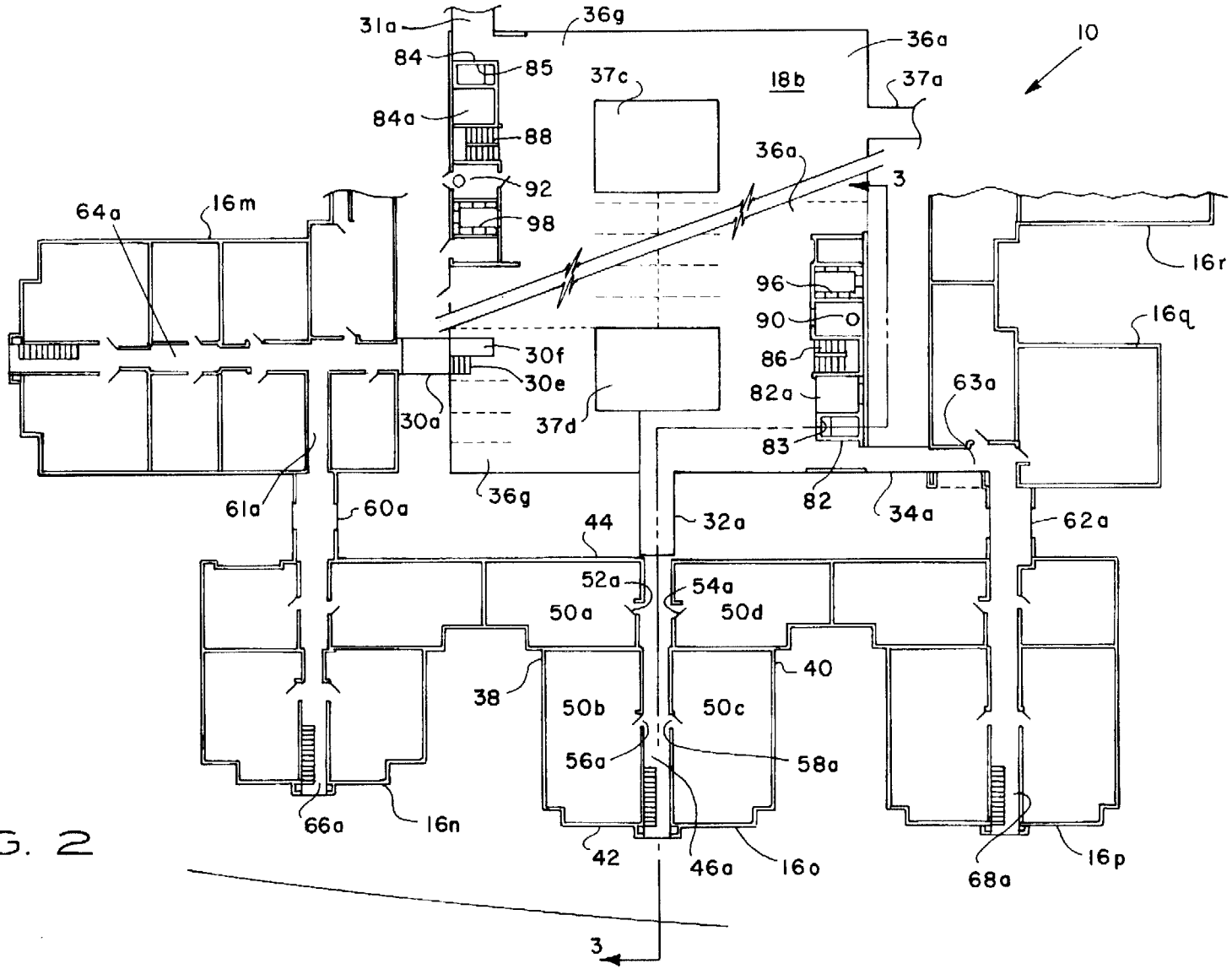
FIG. 2 is a detail plan view, taken generally from line 2—2 of FIG. 3, of a portion of the building complex shown in FIG. 1 on a larger scale.

Referring now to FIG. 2, an exemplary arrangement of buildings 16*m*, 16*n*, 16*o*, 16*p* and 16*q* is illustrated showing how these buildings are clustered around garage 18*b* and interconnected to the garage at the fourth floor or level by respective bridges 30*a*, 32*a* and 34*a*, for example. Buildings 16*k*, 16*l*, 16*r* and 16*s* are also clustered around garage 18*b* and include bridges 31*a*, 33*a*, 35*a* and 37*a* between the garage and the uppermost floors, respectively, see FIG. 1. The buildings 16*m* through 16*q* may be three or four story buildings and a four story building is shown by way of example for building 160 in FIG. 3. Consequently, garage 18*b* also includes at least four decks or levels, including a ground level and three vertically stacked levels thereabove. Garage 18*b* includes, for example, a vehicle parking level or deck 36*a* which is at the same elevation as the fourth floor of at least buildings 16*o* through 16*s* as will be understood from further description herein. Each of buildings 16*a* through 16*z* has multiple dwelling units therein. Building 160 will be described in further detail and is exemplary.

Figure 3:
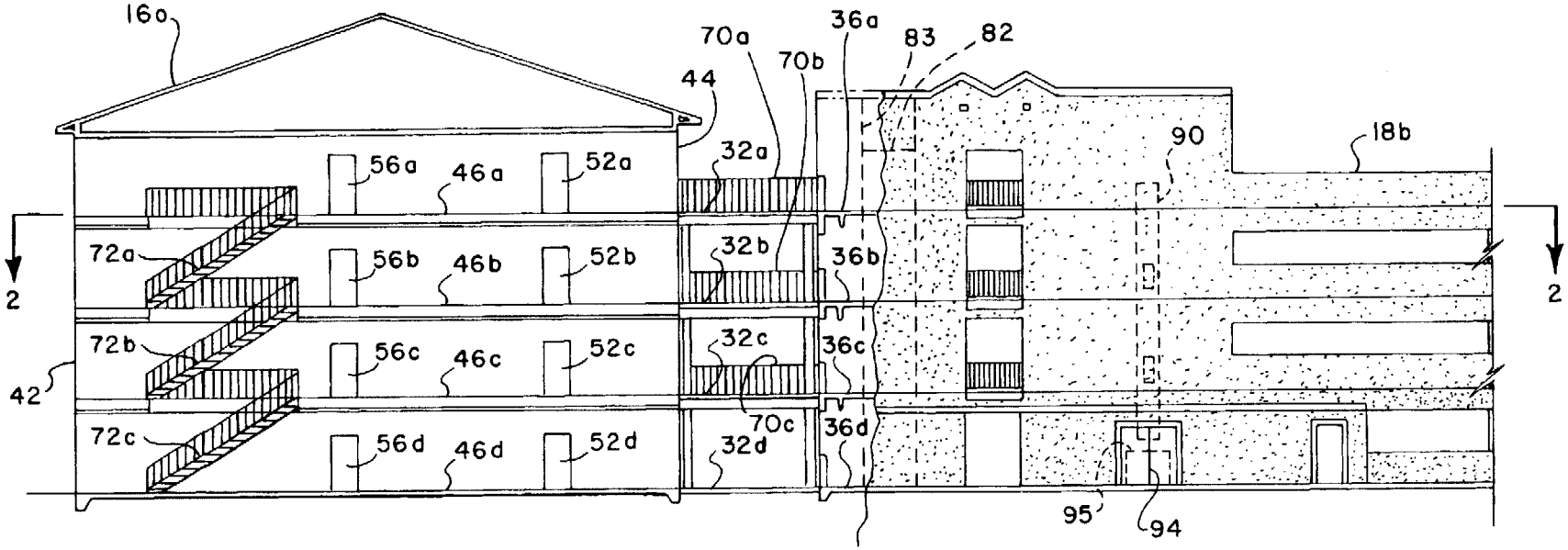
FIG. 3 is a view taken generally from the line 3—3 of FIG. 2.

Referring further to FIG. 2 and FIG. 3, building 16*o* is defined by exterior sidewalls 38 and 40 contiguous with opposed end walls 42 and 44. Each level or floor of building 16*o* is provided with a central open corridor or breezeway 46*a* through 46*d*. Fourth floor breezeway 46*a* is shown in FIG. 2. Breezeway 46*a* is contiguous with and at the same elevation as bridge 32*a* which, in turn, is at the same elevation as parking deck 36*a*. At least bridges 34*a*, 35*a* and 37*a* are also contiguous with and at the same level or elevation as parking deck 36*a*. Building 16*o* includes dwelling units 50*a*, 50*b*, 50*c* and 50*d*. Dwelling units 50*a* and 50*d* open to breezeway 46*a* by way of entrances 52*a* and 54*a*, respectively, and dwelling units 50*b* and 50*c* open into breezeway 46*a* at entrances 56*a* and 58*a*, respectively.

Further, by way of example, each of buildings 16*m* through 16*q* includes an appropriate breezeway forming a pathway between the respective dwelling units and bridges 30*a*, 32*a* or 34*a*. Buildings 16*n* and 16*p* have bridges 60*a* and 62*a* at their fourth floors or levels which interconnect the upper or fourth level dwelling units in these buildings with breezeways 61*a* and 63*a* in buildings 16*m* and 16*q*, respectively, which provide access between garage 18*b* and buildings 16*n* and 16*p*. Breezeways or corridors 64*a* in building 16*m*, 66*a* in building 16*n* and 68*a* in building 16*p* provide access to the dwelling units in these buildings disposed on either sides of these breezeways or corridors in generally the same manner as described above for building 16o. Those skilled in the art will recognize that other specific corridor or pathway configurations and floor plans may be provided, including floor plans wherein the entrances to the occupiable units open onto balcony structures on the exterior walls of the buildings, for example.

However, in accordance with the present invention, a particular level or floor of each building of a cluster of buildings, such as buildings 16m through 16q, has a pathway at substantially the same elevation as that of a particular parking deck in an adjacent garage and which is connected to that parking deck by a bridge wherein substantially no change in elevation is required by a person walking or otherwise moving between a dwelling unit of a building and a corresponding vehicle parking deck or level of the garage 18b.

FIG. 3 indicates that each of four vertically spaced garage parking decks, indicated by numerals 36a through 36d are provided and correspond to the four levels or floors of building 16o, which building is provided with breezeways 46a through 46d corresponding to and defining the elevation of each floor, respectively. The floor plan of the uppermost or fourth floor of building 16o may be repeated at the respective levels having the same elevations as breezeways 46b, 46c and 46d. For example, as shown in FIG. 3, entrances 56b, 56c and 56d and entrances 52b, 52c and 52d are shown at each floor corresponding to the dwelling units at that floor, respectively. Ground level breezeway 46d is connected to garage parking level 36d by a walkway 32d while breezeway 46c is connected to garage deck 36c by a bridge or catwalk 32c and breezeway 46b is connected to garage deck 36b by a bridge or catwalk 32b. The upper level bridges or catwalks 32a, 32b and 32c are preferably provided with suitable guard railings 70a, 70b and 70c, as shown. Each building in the complex 10 is also preferably provided with suitable stairways 72a, 72b and 72c interconnecting the respective breezeways at the respective levels of each building. An exemplary arrangement is illustrated in FIG. 3 for building 16o.

Referring further to FIGS. 2 and 3, the building complex 10 also advantageously includes a unique arrangement of facilities in each of the garages. Garage 18b, for example, is characterized by a generally rectangular floor plan and includes conventional mechanical elevators or lifts 82 and 84 disposed at diagonally opposite corners of the garage in suitable shafts 83 and 85, respectively. An elevator 82 is disposed adjacent bridge 34a, as shown by way of example in FIG. 2 and is reasonably close to bridges 32a through 32d and bridge 30a, also as shown. Each of elevators 82 and 84 are served by suitable equipment disposed in enclosures 82a and 84a, respectively. Stairways 86 and 88 are also provided between the respective garage decks at opposite corners of the garage 18b, as shown.

Still further, suitable trash receiving conduits 90 and 92 are disposed extending between each deck of the garage 18b and may be characterized by vertical ducts, as shown, which lead to a suitable collection receptacle 95, for example, FIG. 3, at level 36d. Access to the trash collection receptacle for each trash collection duct 90 and 92 may be obtained through a doorway, such as doorway 94, see FIG. 3, for trash collection receptacle 95 and duct 90. Moreover, one or more decks of garage 18b may include a cluster of mailboxes, such as mailboxes 96 shown on deck 36a in FIG. 2, and mailboxes 98 disposed on an intermediate deck 36g to be described further herein. Still further, mailbox clusters or kiosks may be located only on the lower or ground level or deck 36d, for example.

Referring again briefly to FIG. 1, it will be noted that loading zone 26b is in proximity to elevator 84 for garage 18b whereby large objects, including furniture and the like may be loaded onto or unloaded from a vehicle at loading zone 26b, transported via the elevator between loading zone 26b and a desired garage deck and transported between the respective garage deck desired in garage 18b and one of the buildings clustered around and connected to the garage without having to lift such objects for transport up or down stairways, for example. Again, by providing a multistory garage adjacent to a multistory, multiunit building with connecting bridges between the building and the garage at each level, pedestrian and article transport between a dwelling unit on a particular building floor or level and a corresponding garage deck at the same elevation is facilitated.

Figure 4:
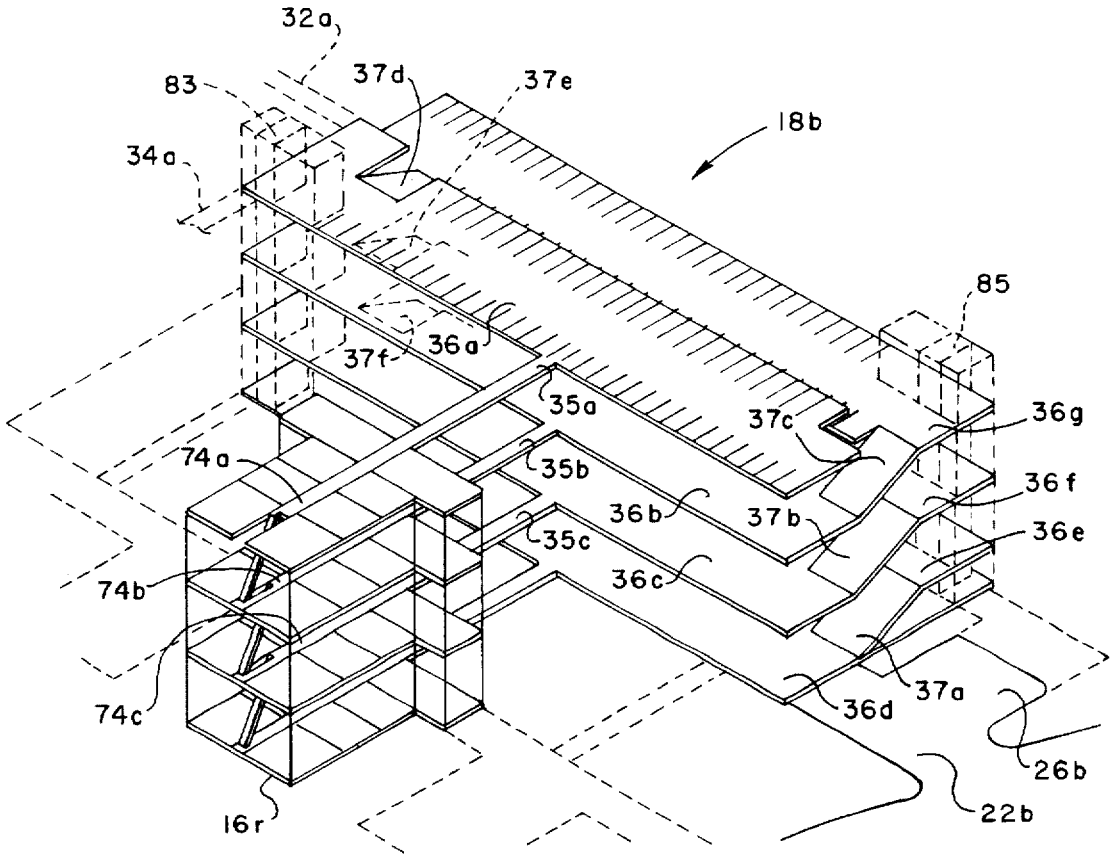
FIG. 4 is a somewhat schematic diagram illustrating certain features of the multistory, multiunit building and garage complex in accordance with the present invention.

Referring now to FIG. 4, one embodiment of the garage 18b is illustrated in somewhat schematic form to indicate the arrangement of the vehicle parking decks and the bridges or pathways between the respective parking decks and a multistory, multiunit building, such as building 16r shown. The exemplary garage 18b is configured for two-way traffic between the parking decks or levels 36a through 36d. As shown in FIG. 4, the ground garage parking level or deck 36d is connected to an intermediate deck 36e by a ramp 37a. Deck 36e is connected to deck 36c by a suitable ramp 37f at the opposite end of the garage 18b. In like manner, deck 36c is connected to an intermediate deck 36f by a ramp 37b and deck 36f is connected to deck 36b by a ramp 37e also at the end of the garage opposite the ramps 37a and 37b. Still further, deck 36b is connected to intermediate deck 36g by a ramp 37c and deck 36g is connected to deck 36a by a connecting ramp 37d. Ramp 37d is disposed at the end of garage 18b at which ramps 37e and 37f are located and these ramps may be disposed directly vertically spaced one from the other, as shown.

FIG. 4 further illustrates the inventive arrangement of bridges 35a, 35b and 35c interconnecting decks 36a, 36b and 36c with breezeways 74a, 74b and 74c of building 16r. Building 16r has plural living units arranged generally in the same manner as building 16o, as indicated by the plan view of FIG. 1. Depending on the type of deck arrangement in a garage, such as the garage 18b, buildings clustered around the garage may have their bridges or catwalks connecting their breezeways or other building corridors with the garage decks arranged such that certain buildings may require steps or sloping ramps interconnecting the garage deck adjacent that building with a particular building floor level. For example, the fourth levels of buildings 16k, 16l, 16m and 16n may have bridges or catwalks interconnected to deck 36g. However, since the elevation of the fourth floors of buildings 16k, 16l, 16m and 16n are substantially co-planar with deck 36a, it would be necessary to provide steps, ramps or sloping bridges 31a 33a and 30a, respectively, down to deck 36g.

Referring to FIG. 2, bridge 30a is shown connected to deck 36g by a stairway 30e and a sloping ramp 30f alongside the stairway. Alternatively, bridge 30a could be sloped between corridor 64a and deck 36g. In like manner, the third levels of the aforementioned buildings 16k through 16n would also require ramps, steps or sloping bridges down to intermediate garage deck 36f and the second level of buildings 16k through 16n may also require steps or ramps between their bridges and intermediate parking deck 36e.

In all events, at least a significant number of buildings clustered around a garage, such as garages 18a through 18c, and in accordance with the invention, may have bridges or walkways interconnecting the respective building floors with a corresponding garage deck without the necessity of stepping up or down when moving between the deck and the breezeway or corridor at the same elevation as the dwelling units. In this way, residents may be assigned parking spaces on deck 36*a*, for example, and may walk between that deck and the bridges to buildings 16*o*, 16*p*, 16*q*, 16*r* and 16*s* without any step up or down. Residents on the first, second and third levels of these same buildings would also have access between their dwelling unit breezeways or corridors and decks 36*d*, 36*c* and 36*b* without stepping up or down a stairway or ramp.

Still further, the garages 18*a* through 18*c* could have continuously sloping parking decks which may, depending on the configuration of clustering of the buildings around the garage, provide for an increased number of bridges or walkways interconnecting a particular deck with a particular building at the same elevation, and thus not requiring any step up or step down between a parking deck and the elevation of a corresponding corridor or breezeway providing access to a dwelling unit. Alternatively, the garage may be configured such that each deck is substantially horizontal and disposed at the same elevation as a floor of an adjacent building, particularly if space requirements permit the vehicle connecting ramps to occupy enough space to allow each deck to be horizontal and at the same elevation as a corresponding floor of an adjacent building. Again, depending on the configuration of the garage and the adjacent building or buildings, all of the living units of a multistory building or buildings may be at the same elevation as a parking deck in the garage and connected to that parking deck by a substantially horizontal bridge or catwalk.

The arrangement of entrances and exits to the garage 18*b* may also be such as to enhance traffic flow and minimize congestion in a two-way garage. The entrances 22*a* through 22*c* are exemplary in this regard and the garage entrances may be located in other positions. Moreover, the arrangement of the vehicle access ramps between decks may also be other than that illustrated in the interest of providing greater space for two-way traffic between decks. Accordingly, the garages 18*a*, 18*b* and 18*c* are somewhat exemplary with respect to the deck arrangements, the interconnecting vehicle ramps, the garage entrances and the specific location of the elevators, trash collection ducts and mailbox clusters with respect to the ramps and entrances.

The construction and use of the building complex 10 is believed to be within the purview of those skilled in the art based on the foregoing description. The buildings 16*a* through 16*z* and garages 18*a*, 18*b* and 18*c* may be constructed using conventional building materials and engineering methods. Those skilled in the art will also recognize that the particular configuration of building units clustered around a garage may be varied in accordance with the available site area and roadway access as well as other geographical or topographical factors. For example, the garage may be disposed adjacent to a roadway and have access bridges between each deck level and an adjoining building breezeway or corridor along only one side or one or both ends of the garage. The particular shapes of the garages may be varied as indicated in FIG. 1.

Although a preferred embodiment of the invention has been described in detail, those skilled in the art will also recognize that various substitutions and modifications may be made without departing from the scope and spirit of the invention as recited in the appended claims.

What is claimed is:

1. In combination, a multistory building having plural vertically spaced floors above ground level and multiple dwelling units on each floor, each floor of said building having corridor means extending to an entrance to each of said multiple dwelling units on each floor;

a multilevel vehicle parking garage disposed adjacent to said building and having a plurality of vertically spaced parking decks for parking vehicles thereon, respectively, at least two of said decks being disposed, respectively, at an elevation corresponding to the elevation of one of said floors, respectively;

a bridge interconnecting each of said at least two decks with said corridor means of a corresponding floor at said elevation and forming a pathway between said corridor means of said floors and the corresponding deck whereby an occupant of a unit on each of said floors may move between said unit and said corresponding deck; and at least one elevator disposed in said garage and being movable between said decks and an article loading and unloading zone disposed adjacent said garage at ground level for moving articles between said zone and said elevator for transport of said articles between said zone and a unit of said building without a change in elevation, except in said elevator.

2. The invention set forth in claim 1 wherein:

said building has at least three floors vertically spaced and each floor above ground level includes a bridge interconnecting corridor means of said each floor above ground level with a corresponding deck of said garage at the elevation of said each floor above ground level, respectively, whereby persons may move between a unit on a particular floor above ground level of said building and a deck at the elevation of said particular floor above ground level without encountering a stairway.

3. The invention set forth in claim 1 wherein:

said garage is substantially rectangular and plural buildings are disposed adjacent to at least one side of said garage, each of said buildings having at least one floor above ground level and having a dwelling unit thereon, a corridor adjacent said dwelling unit of each building forming a pathway between an entrance of each dwelling unit and a bridge connecting said building to said garage at a deck having an elevation corresponding to said corridor of said floor above ground level whereby persons may move between respective dwelling units of said buildings, respectively, and a deck of said garage without changing elevation.

4. The invention set forth in claim 1 wherein:

said garage includes plural elevators spaced apart one from the other and movable between said decks, respectively.

5. The invention set forth in claim 1 including:

a vertically disposed trash duct interconnecting said decks with a ground level receptacle.

6. The invention set forth in claim 1 including:

a mailbox disposed in said garage at each deck.

7. A multifamily dwelling complex comprising:

a multilevel vehicle parking garage having a plurality of vertically spaced parking decks for parking vehicles thereon, respectively;

plural multistory buildings, each including an exterior wall disposed adjacent said garage and spaced therefrom a predetermined distance, each of said buildings including plural, vertically spaced floors, each floor including at least one dwelling unit and a corridor adjacent said dwelling unit and forming a pathway between an entrance to said dwelling unit and said exterior wall of said building, respectively;

bridge means interconnecting each corridor with a deck in said garage said deck being disposed at an elevation corresponding to the elevation of said corridor, respectively, whereby occupants of said units on each floor of said buildings, respectively, may move between said units and said decks without changing elevations, respectively;

at least one elevator disposed in said garage and movable between said decks and a ground level loading zone adjacent said garage;

a stairway disposed adjacent said elevator aid extending between said decks;

a trash disposal duct extending between said decks and a trash receptacle disposed substantially at ground level in said garage; and a mailbox disposed on each deck for each dwelling unit accessible from each deck, respectively, at an elevation corresponding to each deck, respectively.

8. A multifamily dwelling complex comprising:

a multilevel, generally rectangular, vehicle parking garage having a plurality of vertically spaced parking decks for parking vehicles thereon, respectively;

plural multistory buildings disposed adjacent to and spaced from said garage along at least three sides of said garage, each of said buildings including plural vertically spaced floors, each floor including plural dwelling units and a corridor forming a pathway between an entrance to each dwelling unit, respectively, and an exterior wall of said building, respectively;

bridges interconnecting respective ones of said corridors in each building with a parking deck at an elevation corresponding to the elevation of said each corridor, respectively so as to form a pathway between each dwelling unit on each floor and a corresponding parking deck which may be traversed without requiring a change in elevation;

said garage including at least one intermediate parking deck extending along one side of said garage at an elevation which is intermediate the elevations of two other parking decks disposed along another side of said garage;

a bridge between said intermediate deck and a floor of one of said buildings disposed adjacent said one side of said garage and including a ramp sloping between said intermediate deck and said floor of said one building;

a first elevator disposed in said garage and movable between a ground level entrance of said garage and selected ones of said decks; and a second elevator in said garage and disposed along a side of said garage opposite said first elevator, said second elevator being movable between a ground level entrance of said garage and said intermediate decks.

9. The invention set forth in claim 8 including:

an article loading and unloading zone disposed adjacent said garage for moving articles between said zone and one of said elevators for transport of said articles between said zone and s; unit of one of said building without substantially changing elevation except in said one elevator.

10. The invention set forth in claim 8 including:

a vertically extending trash duct disposed in said garage and interconnecting said decks, respectively, with a ground level receptacle.

11. The invention set forth in claim 8 including:

a mailbox disposed in said garage at each deck which is connected to a bridge between said each deck and one of said buildings.

12. The invention set forth in claim 8 wherein:

said garage includes a cluster of an elevator, a stairway, a vertically extending trash duct and a mailbox disposed on each deck of said garage which is connected to one of said bridges.

* * * * *